US006879804B2

(12) United States Patent
Park

(10) Patent No.: US 6,879,804 B2
(45) Date of Patent: Apr. 12, 2005

(54) LIQUID ELECTROPHOTOGRAPHIC IMAGE FORMING APPARATUS HAVING A WASTE DEVELOPING AGENT CONTAINER

(75) Inventor: Eun-sang Park, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 107 days.

(21) Appl. No.: 10/338,664

(22) Filed: Jan. 9, 2003

(65) Prior Publication Data

US 2004/0028434 A1 Feb. 12, 2004

(30) Foreign Application Priority Data

Aug. 9, 2002 (KR) ..... 10-2002-0047206

(51) Int. Cl.[7] ..... G03G 15/10; G03G 21/10
(52) U.S. Cl. ..... 399/348; 399/360; 399/120
(58) Field of Search ..... 399/348, 358, 399/360, 237, 262, 111, 120

(56) References Cited

U.S. PATENT DOCUMENTS

| | | | | |
|---|---|---|---|---|
| 4,660,960 A | * | 4/1987 | Fukunaga et al. | 399/360 X |
| 4,963,940 A | * | 10/1990 | Nemoto et al. | 399/262 |
| 5,079,591 A | * | 1/1992 | Tomita et al. | 399/262 |
| 5,878,304 A | * | 3/1999 | Watanabe et al. | 399/92 |
| 6,175,701 B1 | * | 1/2001 | Kwon | 399/360 X |
| 6,295,430 B1 | * | 9/2001 | Kang | 399/348 X |
| 6,339,689 B1 | * | 1/2002 | Sugiura | 399/120 |
| 6,353,721 B1 | * | 3/2002 | Yamaguchi et al. | 399/237 |

FOREIGN PATENT DOCUMENTS

| | | |
|---|---|---|
| JP | 05-107918 | * 4/1993 |
| JP | 09-281866 | 10/1997 |

* cited by examiner

*Primary Examiner*—Sophia S. Chen
(74) *Attorney, Agent, or Firm*—Staas & Halsey LLP

(57) ABSTRACT

A liquid image forming apparatus includes a waste developing agent container in which a developing agent removed by the cleaning blade from a photosensitive body is stored. The waste developing agent container is provided in a developing container.

16 Claims, 5 Drawing Sheets

LIQUID ELECTROPHOTOGRAPHIC IMAGE FORMING APPARATUS HAVING A WASTE DEVELOPING AGENT CONTAINER

CROSS-REFERENCE TO RELATED APPLICATIONS

This application claims the benefit of Korean Application No. 2002-47206, filed Aug. 9, 2002, in the Korean Intellectual Property Office, the disclosure of which is incorporated herein by reference.

BACKGROUND OF THE INVENTION

1. Field of the Invention

The present invention relates to a liquid electrophotographic image forming apparatus having a waste developing agent container and, more particularly, to a liquid image forming apparatus having a waste developing agent container holding a waste developing agent from a photosensitive body provided in a developing container.

2. Description of the Related Art

In general, electrophotographic image forming apparatuses form an electrostatic latent image on a photosensitive medium, such as a photosensitive drum or a photosensitive belt, develop the electrostatic latent image by a developing agent of a predetermined color, and transfer the developed image onto a sheet of paper, thereby forming a desired image.

Such electrophotographic image forming apparatuses are classified into a dry type and a wet type according to the type of developing agent. Dry type image forming apparatuses use a powder state of toner, while liquid image forming apparatuses use a liquid developing agent, in which the toner is mixed with a liquid carrier. The liquid image forming apparatuses have better printing quality than the dry type image forming apparatuses and reduce risks of health problems caused by harmful toner dust.

FIG. 1 schematically shows the structure of a conventional liquid color image forming apparatus. FIG. 2 shows a detailed diagram of an image forming unit of FIG. 1 and illustrates a magenta image forming unit M among image forming units having the same structure of FIG. 1.

Referring to FIGS. 1 and 2, a plurality of image forming units are arranged serially on a circulation route of a transfer belt 40, which moves on an endless track by a plurality of rollers 41, 42, and 44. Each of the image forming units transfers cyan (C), magenta (M), yellow (Y), and black (K) images, respectively, onto the transfer belt 40. Each image forming unit includes a photosensitive drum 30, which transfers a toner image of a predetermined color onto the transfer belt 40; a charger 36, which charges the surface of the photosensitive drum 30 at a predetermined electric potential; a laser scanning unit (LSU) 38, which forms an electrostatic latent image by radiating light onto the charged surface of the photosensitive drum 30; a developing unit 10, which develops the electrostatic latent image into a predetermined toner image; and a cleaning blade 31, which removes a developing agent remaining on the photosensitive drum 30 after the developed toner image is transferred onto the transfer belt 40. A waste developing agent removed by the cleaning blade 31 from the photosensitive drum 30 is collected in a waste developing agent tub 32 provided under the cleaning blade 31 and is then brought to and stored in a waste developing agent container 34 via a guide pipe 33 connected to the lower part of the waste developing agent tub 32. Reference numeral 35 denotes an eraser that erases an electric potential on the photosensitive drum 30.

When the transfer belt 40 is supported and rotated by a driving roller 41, a second transfer backup roller 44, and a plurality of first transfer backup rollers 42 corresponding to the photosensitive drum 30, the image that is formed on the photosensitive drum 30 is transferred onto the transfer belt 40. A second transfer roller 43 is installed to rotate in a direction opposite to the rotation of the second transfer backup roller 44, and the transfer belt 40 is placed between the second transfer backup roller 44 and the second transfer roller 43. The second transfer roller 43 transfers the image on the transfer belt 40 onto a sheet of paper 60.

The paper 60, onto which the color image is transferred by the second transfer roller 43, is heated at a predetermined temperature and pressurized by a fusing unit 50 installed on a paper exhaust route, and the toner image is fixed on the paper 60.

The developing unit 10 includes a developing container 14 in which the developing agent (D) is stored; a developing roller 15 of which a portion is dipped in the developing agent (D) and installed to face the photosensitive drum 30; a depositing roller 16; a cleaning roller 17; and a metering roller 18.

Part of the developing roller 15 is dipped in the developing agent (D) stored in the developing container 14. The depositing roller 16 is dipped in the developing agent (D) stored in the developing container 14, and a predetermined voltage is applied to the depositing roller 16 being spaced apart from the developing roller 15 by a predetermined gap. The depositing roller 16 sticks the developing agent (D) onto the surface of the developing roller 15 utilizing a difference in electric potential between the depositing roller 16 and the developing roller 15 having the predetermined voltage.

The metering roller 18 is installed to be adjacent to the developing roller 15 and regulates the developing agent stuck on the developing roller 15 to a predetermined thickness.

The cleaning roller 17 cleans the developing agent (D) remaining on the surface of the developing roller 15 after the developing roller 15 has developed the electrostatic latent image on the photosensitive drum 30.

However, an image forming apparatus having the above structure must separately include a container in which a waste developing agent is stored outside of the developing container, and thus the space within the image forming apparatus should be increased.

SUMMARY OF THE INVENTION

Accordingly, it is an aspect of the present invention to provide a liquid image forming apparatus having a waste developing agent container holding a waste developing agent from a photosensitive body provided in a developing container.

Additional aspects and advantages of the invention will be set forth in part in the description which follows and, in part, will be obvious from the description, or may be learned by practice of the invention.

The foregoing and/or other aspects of the present invention are achieved by providing an image forming apparatus comprising: a developing roller which develops an electrostatic latent image formed on a photosensitive body in a predetermined color; a developing container in which a developing agent supplied to the developing roller is stored; a cleaning blade which removes the developing agent remaining on the photosensitive body after the image developed on the photosensitive body is transferred onto a transfer body; and a waste developing agent container in which the developing agent removed by the cleaning blade from the photosensitive body is stored. The waste developing agent container is provided in the developing container.

In an aspect of the invention, the volume of the waste developing agent container is increased by an inflow of a waste developing agent, and the waste developing agent container is formed of a rubber or polyvinyl material.

In another aspect of the invention, the waste developing agent container is provided to contact the developing agent in the developing container.

Also, the image forming apparatus further includes a waste developing agent tub in which the waste developing agent removed by the cleaning blade from the photosensitive body is temporarily collected; and a guide pipe which connects the waste developing agent tub to the waste developing agent container.

The foregoing and/or other aspects of the present invention may also be achieved by providing a liquid image forming apparatus comprising: a photosensitive body; a developing roller which develops an electrostatic latent image formed on a photosensitive body in a predetermined color; a developing container in which a developing agent supplied to the developing roller is stored; a cleaning blade which removes the developing agent remaining on the photosensitive body after the image developed on the photosensitive body is transferred onto a transfer body; and a waste developing agent container in which the developing agent removed by the cleaning blade from the photosensitive body is stored. In an aspect of the invention, the photosensitive body, the developing roller, the developing container, the cleaning blade, and the waste developing agent container are provided in one cassette.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE INVENTION

Figure 1:
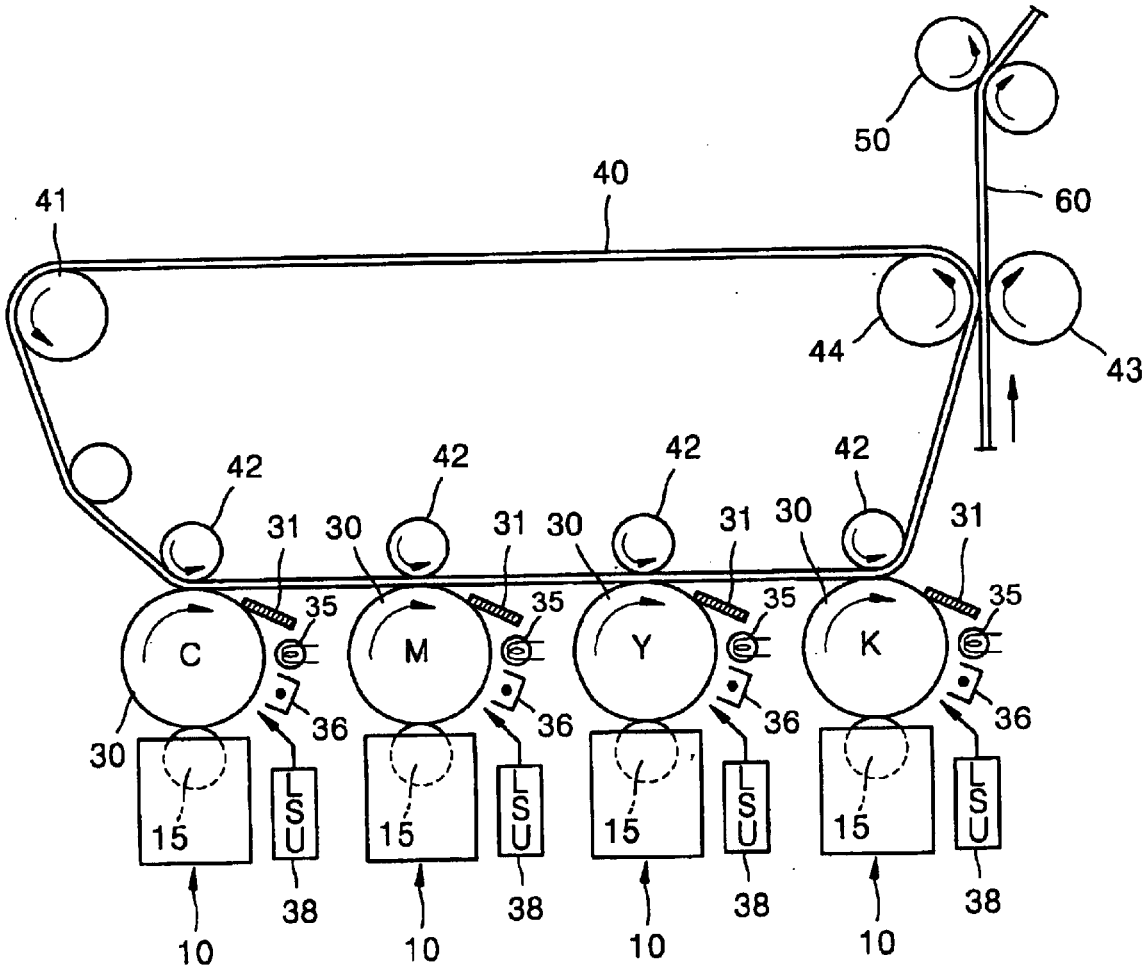
FIG. 1 (PRIOR ART)
FIG. 1 schematically shows the structure of a conventional liquid color image forming apparatus.

Reference will now be made in detail to the embodiments of the present invention, examples of which are illustrated in the accompanying drawings, wherein like reference numerals refer to like elements throughout. The embodiments are described below in order, to explain the present invention by referring to the figures.

Figure 2:
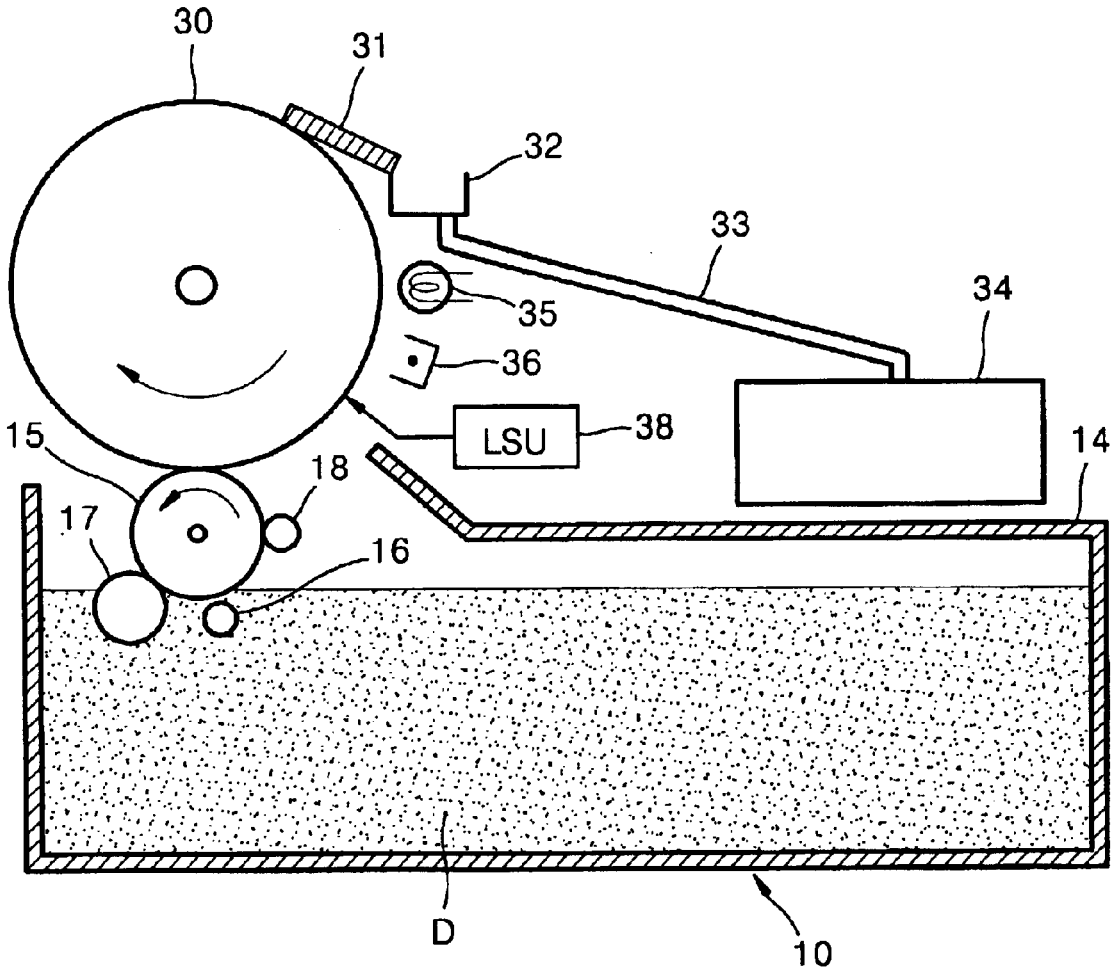
FIG. 2 (PRIOR ART)
FIG. 2 shows a detailed diagram of an image forming unit of FIG. 1.
Figure 3:
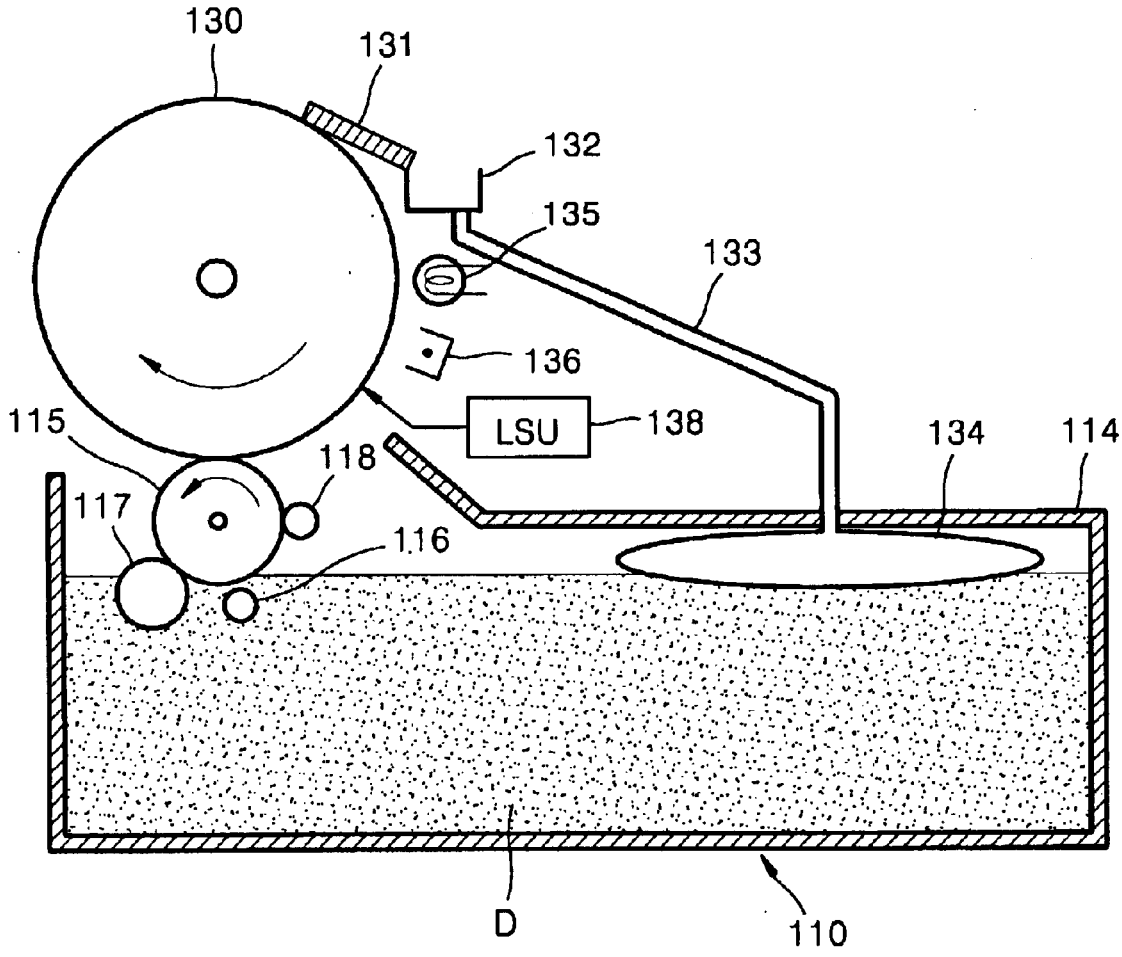
FIG. 3 shows the structure of an image forming unit of a liquid image forming apparatus according to an embodiment of the present invention.

FIG. 3 shows the structure of an image forming unit of a liquid image forming apparatus according to an embodiment of the present invention. The same names are used for the same elements as those in FIGS. 1 and 2, and the detailed descriptions thereof will be omitted.

Referring to FIG. 3, the image forming unit of the liquid image forming apparatus according to this embodiment includes a photosensitive drum 130; a charger 136, which charges the surface of the photosensitive drum 130 at a predetermined electric potential; a laser scanning unit (LSU) 138, which forms an electrostatic latent image by radiating light onto the charged surface of the photosensitive drum 130; a developing unit 110, which develops the electrostatic latent image into a predetermined toner image; and a cleaning blade 131, which removes a developing agent remaining on the photosensitive drum 130 after the developed toner image is transferred onto a transfer belt (40 of FIG. 1). A waste developing agent removed from the photosensitive drum 130 by the cleaning blade 131 is collected in a waste developing agent tub 132 provided under the cleaning blade 131 and is then brought to and stored in a waste developing agent container 134 via a guide pipe 133 connected to the lower part of the waste developing agent tub 132. Reference numeral 135 denotes an eraser that erases the electric potential on the photosensitive drum 130.

The developing unit 110 includes a developing container 114, in which the developing agent is stored; a developing roller 115 of which a portion is dipped in the developing agent (D) and installed to face the photosensitive drum 130; a depositing roller 116; a cleaning roller 117; and a metering roller 118.

Part of the developing roller 115 is dipped in the developing agent (D) stored in the developing container 114. The depositing roller 116 is dipped in the developing agent stored in the developing container 114, and a predetermined voltage is applied to the depositing roller 116 that is spaced apart from the developing roller 115 by a predetermined gap. The depositing roller 116 places the developing agent (D) onto the surface of the developing roller 115 by utilizing a difference in electric potential between the depositing roller 116 and the developing roller 115 having the predetermined voltage.

The metering roller 118 is installed to be adjacent to the developing roller 115 and regulates the developing agent placed on the developing roller 115 to a predetermined thickness.

The waste developing agent container 134, in which the waste developing agent is stored, is provided inside the developing container 114 in which ink of a predetermined color is stored. The waste developing agent container 134 is connected to the waste developing agent tub 132 via the guide pipe 133. The guide pipe 133 passes through the upper part of the developing container 114 and is connected to the waste developing agent container 134.

Preferably, the waste developing agent container 134 is formed of a vinyl or rubber material.

As the waste developing agent flows into the waste developing agent container 134, the volume of the waste developing agent container 134 increases. Thus, the space occupied by the waste developing agent container 134 in the developing container 114 is increased. In general, the developing agent used in the liquid image forming apparatus is composed of toner of a predetermined color and a carrier to carry the toner. Most of the carrier remains in the developing agent, which remains after the photosensitive drum 130 is developed, and the amount of the collected waste developing agent is at most 30% of the used developing agent. Thus, the waste developing agent container 134 should be made by considering the amount of the collected waste developing agent.

The operation of the image forming unit having the above structure will be described in detail with reference to the attached drawings.

First, the operation of an image forming unit will be described. If an electrostatic latent image is formed on the photosensitive drum 130, the developing roller 115 rotates and develops the electrostatic latent image into a predetermined color using a developing agent placed onto the surface of the developing roller 115. The developing agent remaining on the surface of the developing roller 115 is removed by the cleaning roller 117. Subsequently, the developing agent of the depositing roller 116 to which a predetermined voltage is applied is transferred to the developing roller 115. The rotating developing roller 115 meets with the metering roller 118, leaving the developing agent of less than a predetermined thickness on the developing roller 115, and thus the rotating developing roller 115 performs a development operation.

Figure 4:
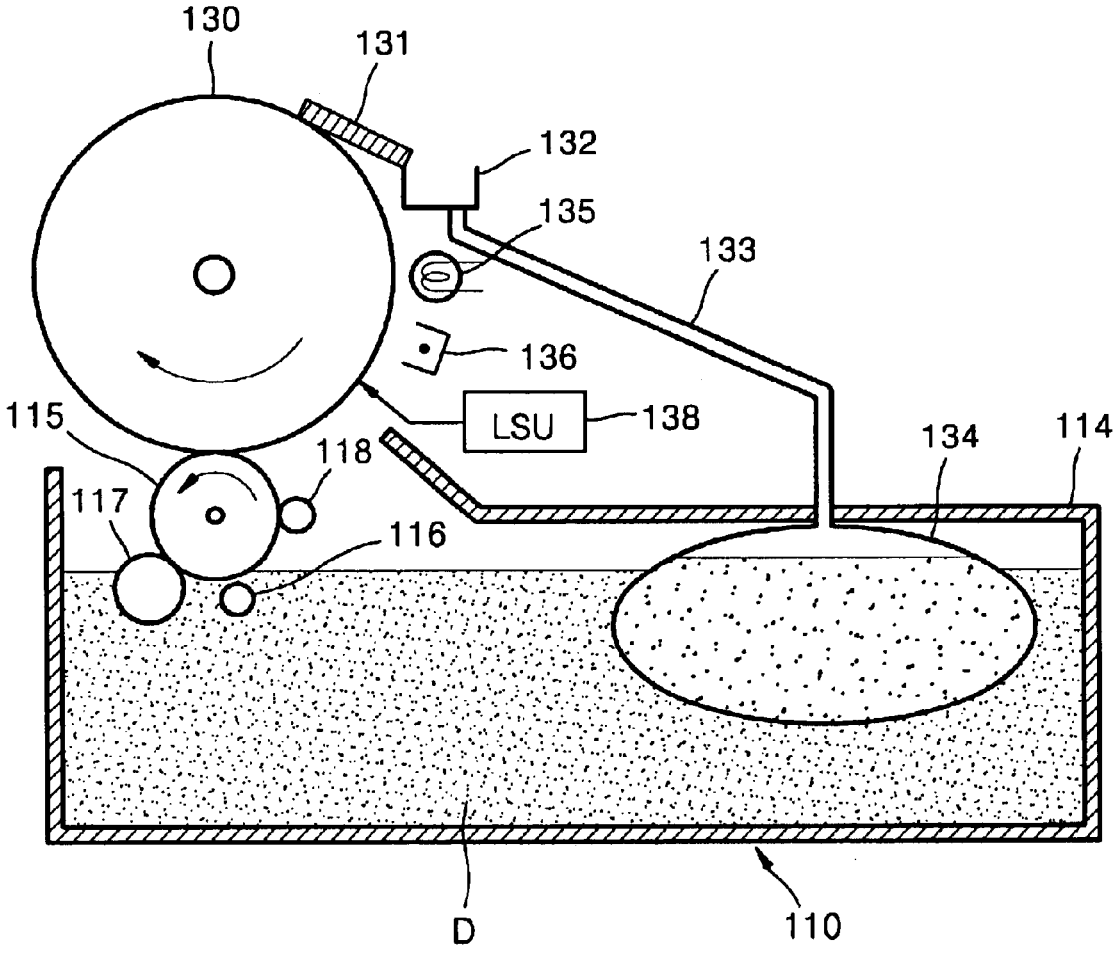
FIG. 4 shows the swollen state of the waste developing agent container of FIG. 3 as it is filled with the waste developing agent.

The photosensitive drum 130, developed by the developing roller 115, transfers the toner image onto the transfer belt 40, and then, the surface of the photosensitive drum 130 is cleaned by the cleaning blade 131. The waste developing agent cleaned from the surface of the photosensitive drum 130 is temporarily stored in the waste developing agent tub 132 provided adjacent to the photosensitive drum 130 and is then poured into the waste developing agent container 134 via the guide pipe 133. As the amount of the waste developing agent that flows into the waste developing agent container 134 increases, the volume of the waste developing agent container 134 increases (see FIG. 4). The amount of increase in the volume of the waste developing agent container 134 is remarkably smaller than the amount of the developing agent used in the developing container 114.

Although not shown in the present embodiment, a developing agent may be supplied from an external source so that the developing container 114 is maintained at a constant level.

Figure 5:
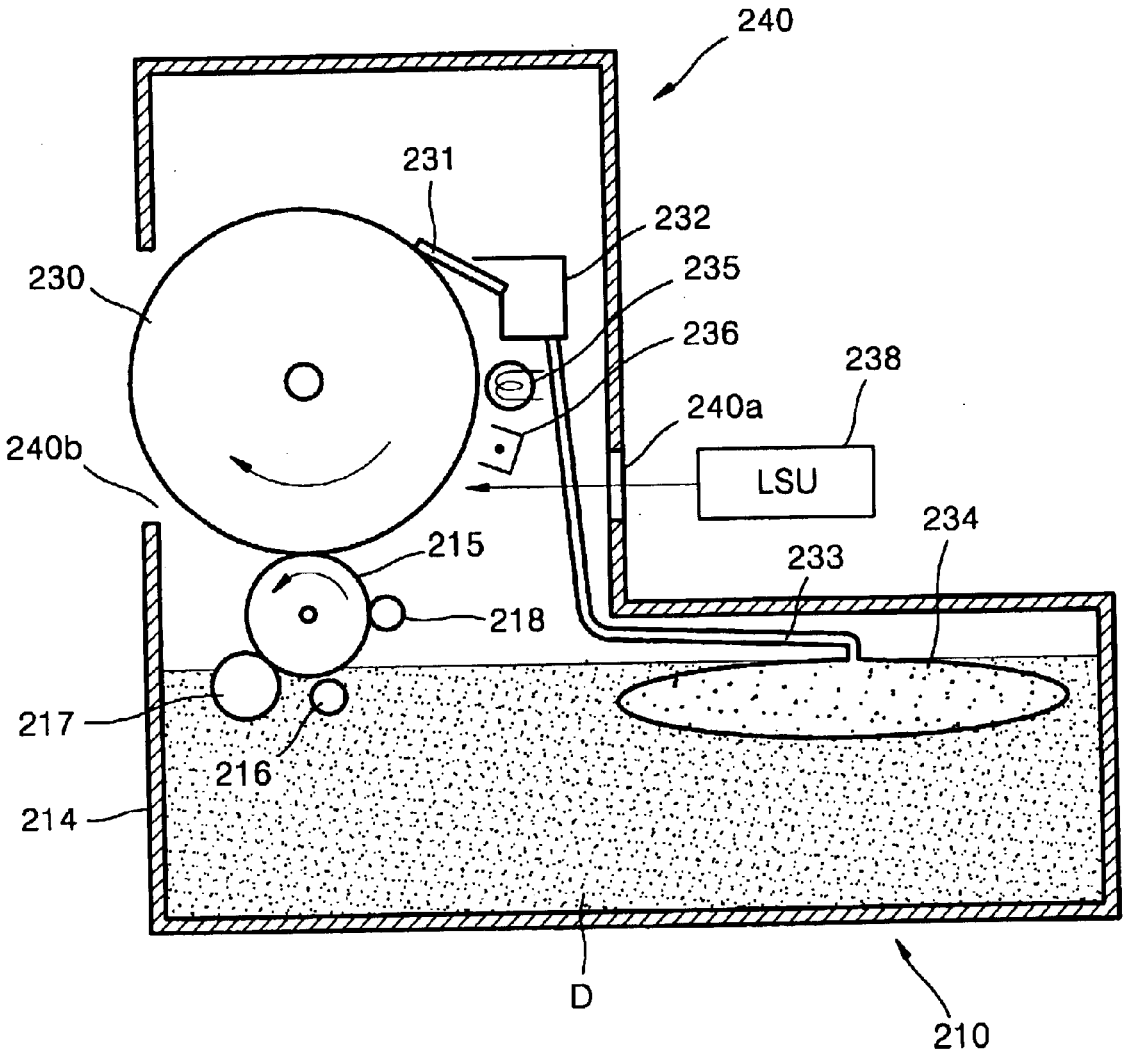
FIG. 5 shows the structure of the image forming unit of the liquid image forming apparatus according to another embodiment of the present invention.

FIG. 5 shows the structure of the image forming unit of the liquid image forming apparatus according to another embodiment of the present invention.

Referring to FIG. 5, in one cassette 240, the following are provided: a photosensitive drum 230; a charger 236, which charges the photosensitive drum 130; a developing unit 210, which develops the electrostatic latent image; a cleaning blade 231, which removes toner on the the photosensitive drum 230 after a transfer step onto a transfer body is completed; and a container 234 in which a waste developing agent removed by the cleaning blade 231 is collected. A laser scanning unit (LSU) 238, which forms an electrostatic latent image on the charged photosensitive drum 230, is placed at one side of the cassette 240. The LSU 238 radiates light onto the photosensitive drum 230 via an open portion 240*a* formed at one side of the cassette 240. Reference numeral 235 denotes an eraser that erases the electric potential on the photosensitive drum 230.

Except for the LSU 238, all other units are formed as one monolithic cassette 240, and the cassette 240 can be replaced with another after being used for a predetermined amount of time. An opening 240*b* for the photosensitive drum 230 contacting the transfer body is formed at one side of the image forming unit. Thus, a plurality of image forming units for transferring color images onto the transfer body should be arranged in a vertical direction.

The developing unit 210 includes a developing container 214, a developing roller 215, a depositing roller 216, a cleaning roller 217, and a metering roller 218.

In addition, although not shown, if the opening 240*b* is placed on the upper portion of the image forming unit, a plurality of image forming units can be arranged in a horizontal direction, as shown in FIG. 1.

The waste developing agent container 234 in which the waste developing agent is stored, is provided in the developing container 214 in which ink of a predetermined color is stored. The waste developing agent container 234 is connected to the waste developing agent tub 232 via the guide pipe 233.

Preferably, the waste developing agent container 234 is formed of a vinyl or rubber material. When the waste developing agent flows into the waste developing agent container 234, the volume of the waste developing agent container 234 increases. Thus the space occupied by the waste developing agent container 234 in the developing container 214 is increased.

As described above, in the liquid image forming apparatus according to the present invention, the waste developing agent container is arranged without requiring an additional space for the waste developing agent container, thereby reducing a space and simplifying the structure of a liquid printer. In addition, the image forming unit including the photosensitive drum is manufactured as one cassette, thereby easily replacing the image forming unit whose life span has terminated with another one.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A liquid image forming apparatus comprising:

a developing roller which develops an electrostatic latent image formed on a photosensitive body;

a developing container in which a developing agent supplied to the developing roller is stored;

a cleaning blade which removes the developing agent remaining on the photosensitive body after the image developed on the photosensitive body is transferred onto a transfer body; and a waste developing agent container in which the developing agent removed by the cleaning blade from the photosensitive body is stored, wherein the developing container and the waste developing agent container do not share a wall, and wherein the waste developing agent container is provided in the developing container.

2. The apparatus of claim 1, wherein the volume of the waste developing agent container increases due to an inflow of the developing agent as a waste developing agent.

3. The apparatus of claim 2, wherein the waste developing agent container is formed of a rubber or polyvinyl material.

4. The apparatus of claim 1, wherein the waste developing agent container contacts the developing agent in the developing container.

5. The apparatus of claim 1, further comprising:

a waste developing agent tub In which the waste developing agent removed by the cleaning blade from the photosensitive body is temporarily collected; and a guide pipe which connects the waste developing agent tub to the waste developing agent container.

6. A liquid image forming apparatus comprising:

a photosensitive body;

a developing roller which develops an electrostatic latent image formed on the photosensitive body;

a developing container in which a developing agent supplied to the developing roller is stored;

a cleaning blade which removes the developing agent remaining on the photosensitive body after the image developed on the photosensitive body is transferred onto a transfer body; and a waste developing agent container In which the developing agent removed by the cleaning blade from the photosensitive body is stored, wherein the developing container and the waste developing agent container do not share a wall, and wherein the photosensitive body, the developing roller, the developing container, the cleaning blade, and the waste developing agent container are provided in one cassette.

7. The apparatus of claim 6, wherein the volume of the waste developing agent container increases due to an inflow of the developing agent as a waste developing agent.

8. The apparatus of claim 7, wherein the waste developing agent container is formed of a rubber or polyvinyl material.

9. The apparatus of claim 6, wherein the waste developing agent container contacts the developing agent in the developing container.

10. The apparatus of claim 6, further comprising:

a waste developing agent tub in which the waste developing agent removed by the cleaning blade from the photosensitive body is temporarily collected; and a guide pipe which connects the waste developing agent tub to the waste developing agent container.

11. An image forming unit used with an image forming apparatus, comprising:

a developing container to store a developing agent; and a waste developing agent container to store used developing agent, the waste developing agent container being provided within the developing container, wherein the developing container and the waste developing agent container do not share a wall.

12. The image forming unit according to claim 11, wherein the volume of the waste developing agent container increases as the amount of the waste developing agent increases.

13. The image forming unit according to claim 11, further comprising:

a waste developing agent tub to receive the used developing agent as a waste developing agent; and a guide pipe connected between the waste developing agent tub and the waste developing agent container to transfer the waste developing agent from the waste developing agent tub to the waste developing agent container.

14. The image forming unit according to claim 11, wherein the waste developing agent container is formed of a vinyl material.

15. The image forming unit according to claim 11, wherein the waste developing agent container is formed of a rubber material.

16. The image forming unit according to claim 11, wherein the developing agent in the developing container is maintained at a constant level.

* * * * *

UNITED STATES PATENT AND TRADEMARK OFFICE

CERTIFICATE OF CORRECTION

PATENT NO. : 6,879,804 B2
DATED : April 12, 2005
INVENTOR(S) : Eun-Sang Park

It is certified that error appears in the above-identified patent and that said Letters Patent is hereby corrected as shown below:

Column 6,
Line 61, change "In" to -- in --.

Column 7,
Line 9, change "In" to -- in --.

Signed and Sealed this

Twenty-ninth Day of November, 2005

JON W. DUDAS
*Director of the United States Patent and Trademark Office*